US011485625B2

(12) United States Patent
Bilias

(10) Patent No.: US 11,485,625 B2
(45) Date of Patent: Nov. 1, 2022

(54) DRINK DISPENSING DEVICE

(71) Applicant: Panagiotis Bilias, Varkiza Attikis (GR)

(72) Inventor: Panagiotis Bilias, Varkiza Attikis (GR)

(73) Assignee: Panagiotis Bilias, Varkiza Attikis (GR)

( * ) Notice: Subject to any disclaimer, the term of this patent is extended or adjusted under 35 U.S.C. 154(b) by 0 days.

(21) Appl. No.: 17/422,511

(22) PCT Filed: Jan. 14, 2020

(86) PCT No.: PCT/GR2020/000006
§ 371 (c)(1),
(2) Date: Jul. 13, 2021

(87) PCT Pub. No.: WO2020/148559
PCT Pub. Date: Jul. 23, 2020

(65) Prior Publication Data

US 2022/0089427 A1 Mar. 24, 2022

(30) Foreign Application Priority Data

Jan. 14, 2019 (GR) ..... 20190100016

(51) Int. Cl.
*B67D 3/00* (2006.01)
*B67D 1/00* (2006.01)

(52) U.S. Cl.
CPC ..... *B67D 3/0032* (2013.01); *B67D 1/0004* (2013.01); *B67D 3/0009* (2013.01);
(Continued)

(58) Field of Classification Search
CPC .. B67D 3/0032; B67D 3/0067; B67D 3/0083; B67D 3/0029; B67D 3/0054;
(Continued)

(56) References Cited

U.S. PATENT DOCUMENTS 1,910,262 A 5/1933 Schoenfeld
2,058,027 A * 10/1936 Wendell ..... B67D 3/047 222/481

(Continued)

FOREIGN PATENT DOCUMENTS

DE 202004003110 U1 6/2004
DE 202012012504 U1 4/2013

(Continued)

OTHER PUBLICATIONS

International Search Report of PCT/GR2020/000006, dated May 13, 2020.

*Primary Examiner* — Frederick C Nicolas
(74) *Attorney, Agent, or Firm* — Dragon Sun Law Firm, PC; Jinggao Li; Nathaniel Perkins

(57) ABSTRACT

The invention relates to a drink dispensing device which consists of a dividable or single-part cylinder (5), in which stand up bags (7) or bottles (25), (26) are introduced containing beverages that are dispensed through independent taps (10). The device is positioned on a table-top base (3), (4), or on an on-floor base (17), (18), and are connected by a screw (19). The device structure proposed by the present invention may serve in the mounting of one or two stand up bags or even more bags as long as a respective configuration and a respective size are ensured. There is no limitation in size or the type of liquids, which may be alcoholic beverages, juices, oil, vinegar, etc.

8 Claims, 14 Drawing Sheets

(52) U.S. Cl.
CPC ..... *B67D 3/0029* (2013.01); *B67D 3/0035* (2013.01); *B67D 3/0054* (2013.01); *B67D 3/0067* (2013.01); *B67D 3/0083* (2013.01); *B67D 2210/00031* (2013.01); *B67D 2210/00044* (2013.01)

(58) Field of Classification Search
CPC ..... B67D 3/0009; B67D 2210/00031; B67D 2210/00044; B67D 1/0004; B67D 3/0035
See application file for complete search history.

(56) References Cited

U.S. PATENT DOCUMENTS

| | | | | |
|---|---|---|---|---|
| 5,351,861 | A * | 10/1994 | Jovellana ..... | B67D 1/06 222/144 |
| 6,065,303 | A | 5/2000 | Harris | |
| 6,112,537 | A | 9/2000 | Broadbent | |
| 7,757,908 | B1 * | 7/2010 | Buhl, Jr. ..... | B67D 1/06 62/239 |
| 8,794,485 | B2 * | 8/2014 | Lunn ..... | A23G 9/28 222/63 |

FOREIGN PATENT DOCUMENTS

| | | | |
|---|---|---|---|
| EP | 0193336 | A2 | 9/1986 |
| FR | 2950331 | A1 | 3/2011 |
| FR | 2969130 | A1 | 6/2012 |
| WO | 2016/040993 | A1 | 3/2016 |

* cited by examiner

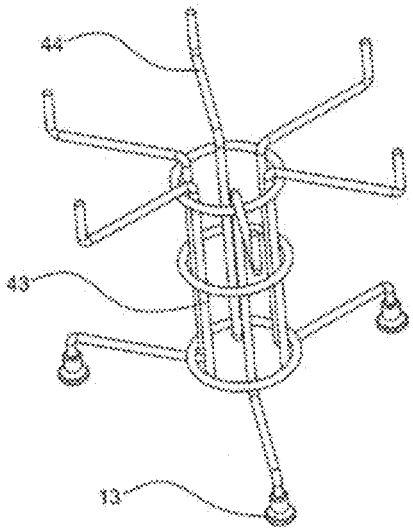
Fig:23
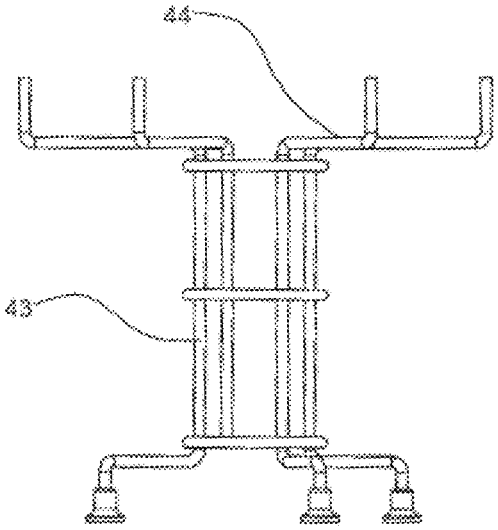
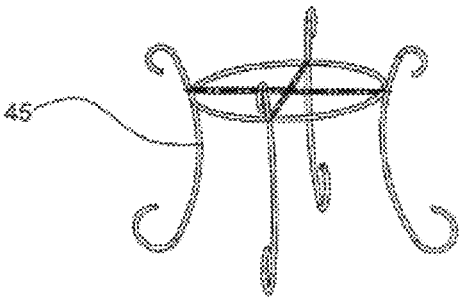
Fig:24
Fig:25

DRINK DISPENSING DEVICE

TECHNICAL FIELD

The invention relates to a drink dispensing device which consists of a dividable or single-part cylinder in which stand up bags or bottles are introduced containing drinks that are dispensed through independent taps.

BACKGROUND

Until today we have introduced various applications with mechanisms, devices or containers in which beverages are packaged in bottles, followed by the process of dispensing them into glasses.

An example is champagne bucket, for champagne, wines and other beverages, which are containers in which ice is placed around the bottles to keep them at low temperatures they should serve. Also drinks such as beer that are packaged with gas pressure where they are adapted to devices with valves for easy flow when serving and dispensing in glasses.

Specialized pumps are also used for the distribution of beverages. Many of the drinks are packaged in bags in box, which are placed in boxes with protruding taps in order to be served in glasses or in jugs.

All of the above methods and applications require special installations and limitations on the uses that are specific to each case.

SUMMARY

In order to face the above disadvantages I have constructed the present invention. The present invention is a new innovative product and elegant design. According to the present invention, one or more drinks in bags or bottles are placed in a cylindrical container with suitable slots.

The cylinder can be placed on a table stand if it serves to be placed on the dinner table or other table. If desired, the cylinder can be placed on an alternate floor stand.

The base is designed to serve the easy distribution and serving of drinks. It is especially suitable for buffet gatherings where everyone chooses their own drink and takes it alone without the intervention of a waiter or other assistant.

There are ice cubes in the beverage area, and insulation is placed around the inside of the barrel to reduce heat loss and maintain cooling.

The invention is described below by means of an example and with reference to the accompanying drawings, in which:

BRIEF DESCRIPTION OF DRAWINGS

FIG. 23 shows the front view of the wire table base,

FIG. 24 shows the perspective view of the wire table base.

FIG. 25 shows an alternate form of the perspective view of the wire table base.

DETAILED DESCRIPTION

Figure 1:
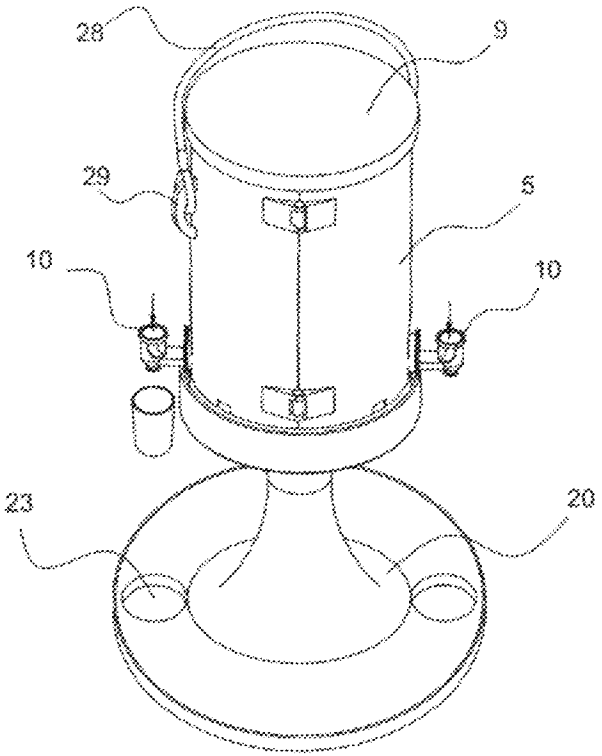
FIG. 1 shows the perspective view of the cylindrical container on a table stand.
Figure 2:
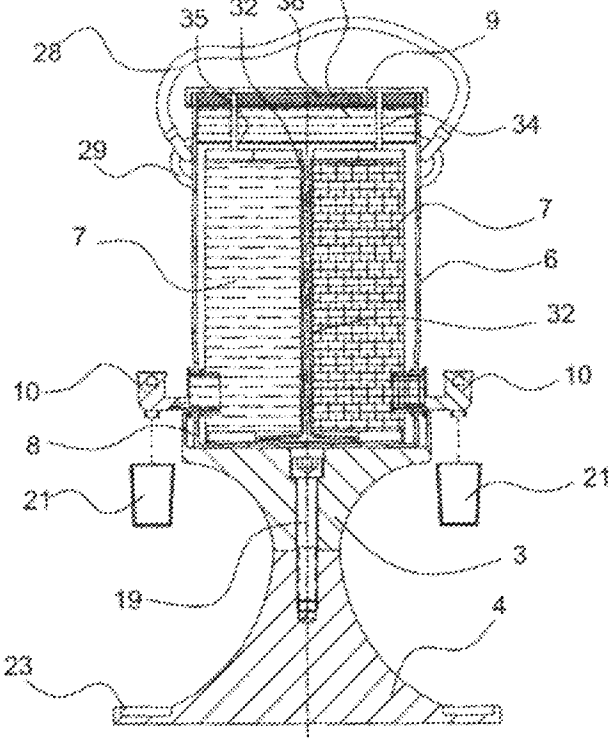
FIG. 2 shows the cylindrical container on the table base with the cross-section of two bags.

FIGS. 1 and 2 shows the beverage dispensing device according to the present invention wherein the dividable cylinder (5) is shown on the devisable table base (20) comprising the upper portion (3) and the lower (4) connected with a screw (19). The lower portion (4) of the base has cavities for the placement (23) of glasses (21). The cylindrical container (5) has configuration (29) where the belt (28) is fitted for easy transport.

From the cylindrical container (5) protrude the taps (10) from which the drinks flow into the glasses (21). The bags (7) are connected with the taps (10). The cylindrical container (6) surrounds the bags (7). Above the cylindrical container (5) is covered by the cap (9) where existing the insulation (36) and the ice pack (37) held by the protrusions (35) of the bars (34) and below it is covered by the cap (8). The plastic plates (32) push the bags until they are completely emptied.

Figure 3:
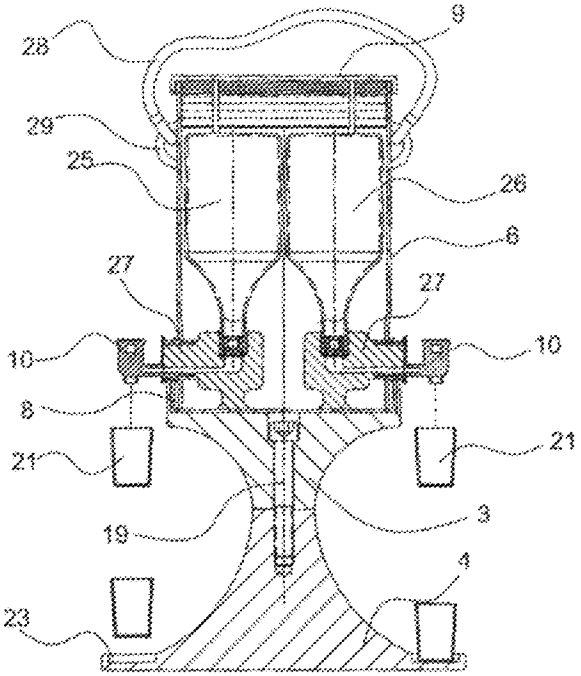
FIG. 3 shows the cylindrical container on the table stand in cross-section of two bottles.

FIG. 3 shows the cylindrical container (5) in which are placed bottles instead bags which are fitted to the specially formed part (27) having an inner screw corresponding to the bottles and a tap (10) corresponding to the bags.

Figure 4:
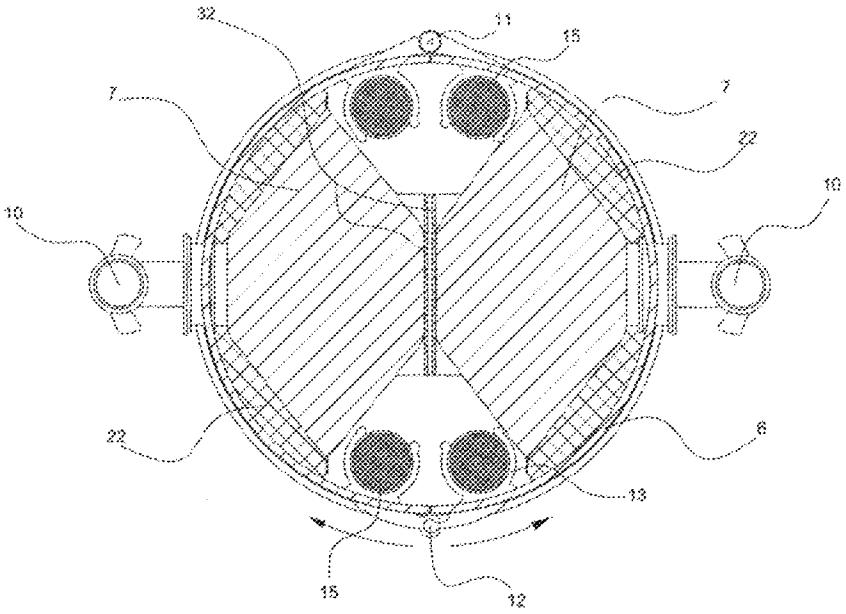
FIG. 4 shows the cylindrical container with two bags in cross section.

FIG. 4 shows the divisible cylinder (5) consisting of the sections (6) connected to the hinges (11) and the cylinder closing (12). Each part (6) of the cylinder (5) has circular configurations (13) in which the ice packs (15) are mounted. The plastic plates (32) are positioned between the bags in order to press and to be emptied completely. Insulation (36) is mounted around it to limit cool loss.

Figure 5:
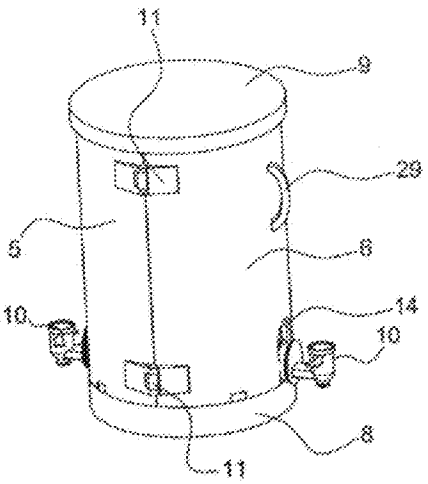
FIG. 5 shows the perspective view of the cylindrical container.

FIG. 5 shows the cylinder (5) consisting of the split cover (6) in perspective view showing the lid (9), the hinges (11) and the configurations (29) for the handles of device, the lower lid (8), the taps (10) and the openings/ports (14) for the fixing the taps (10).

Figure 6:
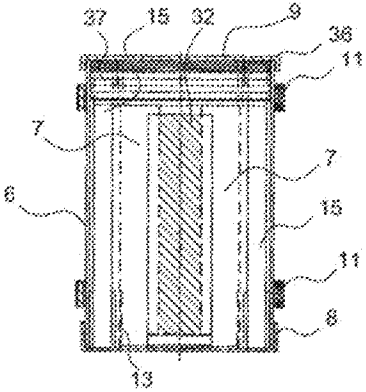
FIG. 6 shows the cylindrical container at cross-section height.

FIG. 6 shows a cylinder (5) at cross-section height consisting of a divisible cover (6), showing the lid (9) in which the insulation is (36) and the ice packs (37) are held by bars (34) and secured with notches (35), hinges (11), lower lid (8), holder for the ice packs (13), stand up bag (7) and ice packs (15).

Figure 7:
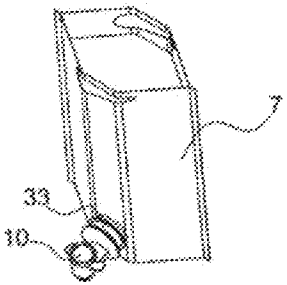
FIG. 7 shows the stand up bag.

FIG. 7 shows a perspective view of the bag (7) with the protruding configuration (33) into which the tap (10) enters.

Figure 8:
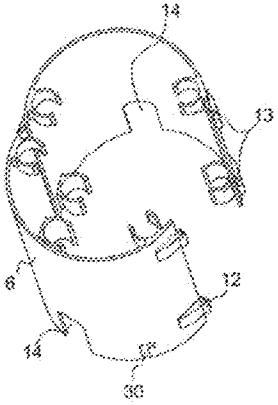
FIG. 8 shows the cylindrical container opened in two parts.

FIG. 8 is a perspective view of the divisible cylinder (5) with the reclining cover (6) in an open position with the formations (13) within of which the ice packs are entered (15), the openings/ports (14) through which the exits of the taps are passed (33) of the bags (7) and the notches (30) within of which the ledges (31) of the lower lid are passing through so that to secure it to remain in the anticipated position.

Figure 9:
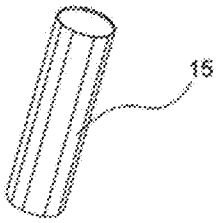
FIG. 9 shows the perspective view of the cylindrical ice packs.

FIG. 9 is a perspective view of the ice pack (15) which is placed in the refrigerator freezer and after being cooled it is placed in the cylinder (5) keeping the room and drinking liquids cold.

Figure 10:
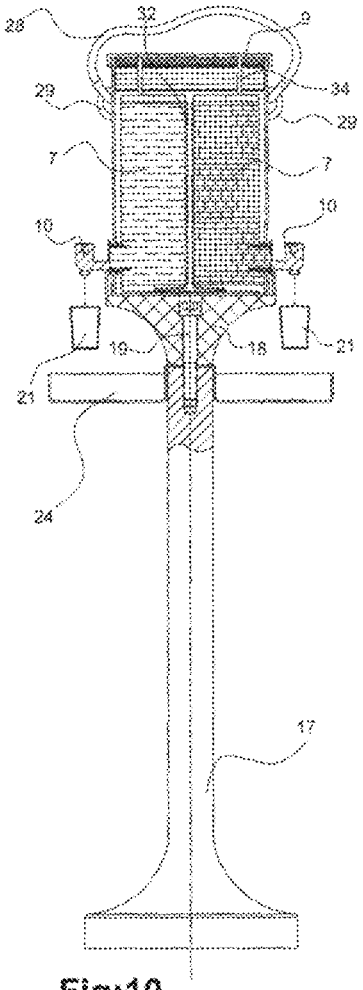
FIG. 10 shows the cylindrical container with two bags on a floor stand at cross-section height.
Figure 11:
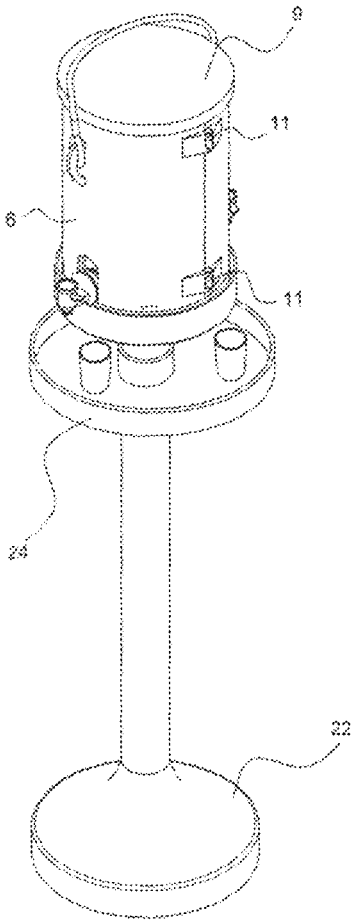
FIG. 11 shows the perspective view of the cylindrical container on a floor stand.

FIGS. 10 and 11 show the drinking liquids dispensing device according to the present invention, and in particular FIG. 11 is a perspective view and FIG. 10 at cross-section height. FIG. 11 shows the cylinder (5) on the divisible floor base consisting of the upper portion (18) and the bottom (17) connected with a screw (19).

Between the upper portion (18) and the lower portion (17) is adjusted the tray (24) to position the glasses (21) when serving and collecting any accidental loss of fluid from the taps. The cylinder (5) has the configurations (29) where the belt (28) is fitted for easy carrying as a bag.

Figure 12:
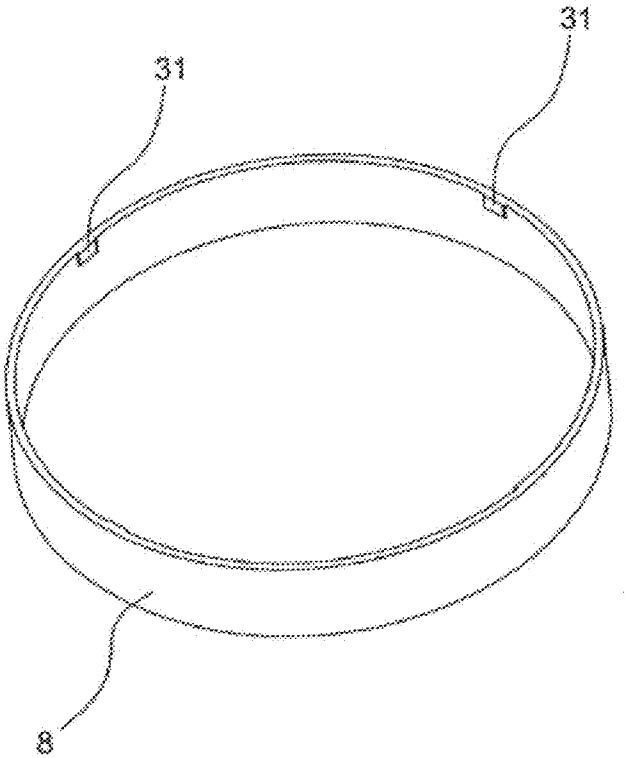
FIG. 12 shows the perspective view of the lower lid of the cylindrical container.

FIG. 12 shows in perspective the lower lid of the cylindrical container where the projections (31) are shown to enter to the notches (30) of the cylinder (5) and rotate by locking it in the provided safe position.

Figure 13:
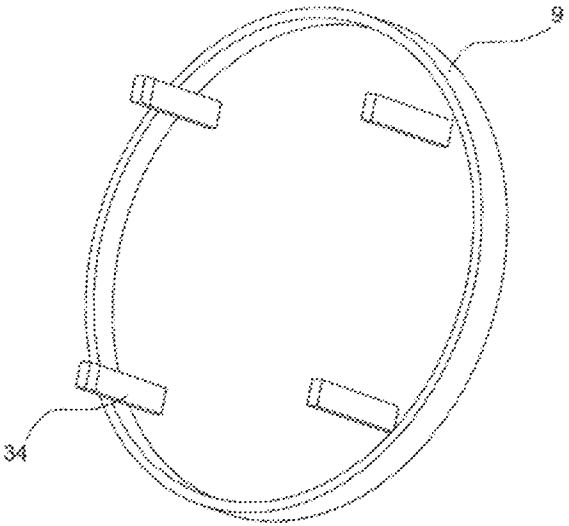
FIG. 13 shows the perspective view of the upper lid of the cylindrical container.

FIG. 13 shows in perspective the upper lid of the cylindrical container showing the bars (34) with the protrusions (35) for locking the insulation (36) and the upper ice pack (37).

Figure 14:
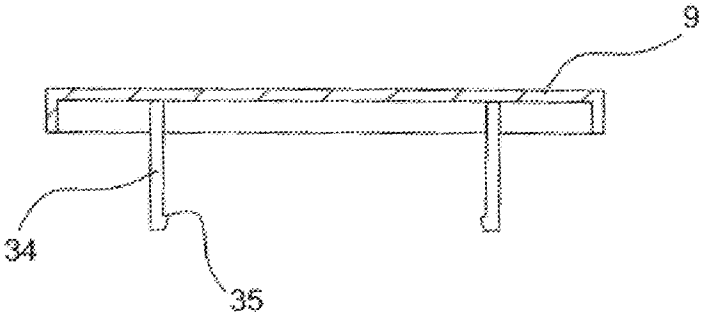
FIG. 14 shows the upper lid of the cylindrical container at cross-section.

FIG. 14 shows a cross-section view of the upper lid of the cylindrical container (5), showing the bars (34) with the notches (35) for locking the upper ice pack (37).

Figure 15:
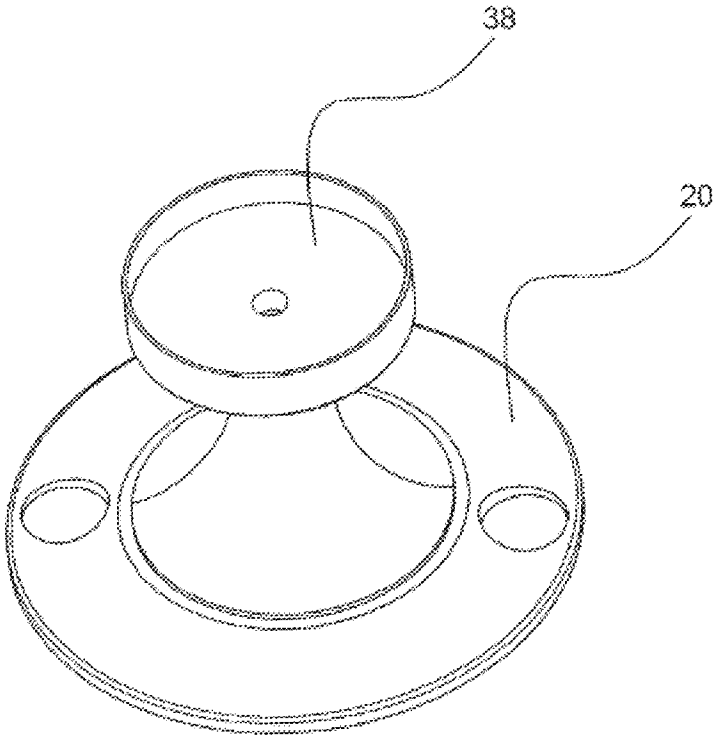
FIG. 15 shows the perspective view of the table stand.

FIG. 15 shows a perspective view of the table stand showing the disc slot (38) into which the cylinder (5) is mounted.

Figure 16:
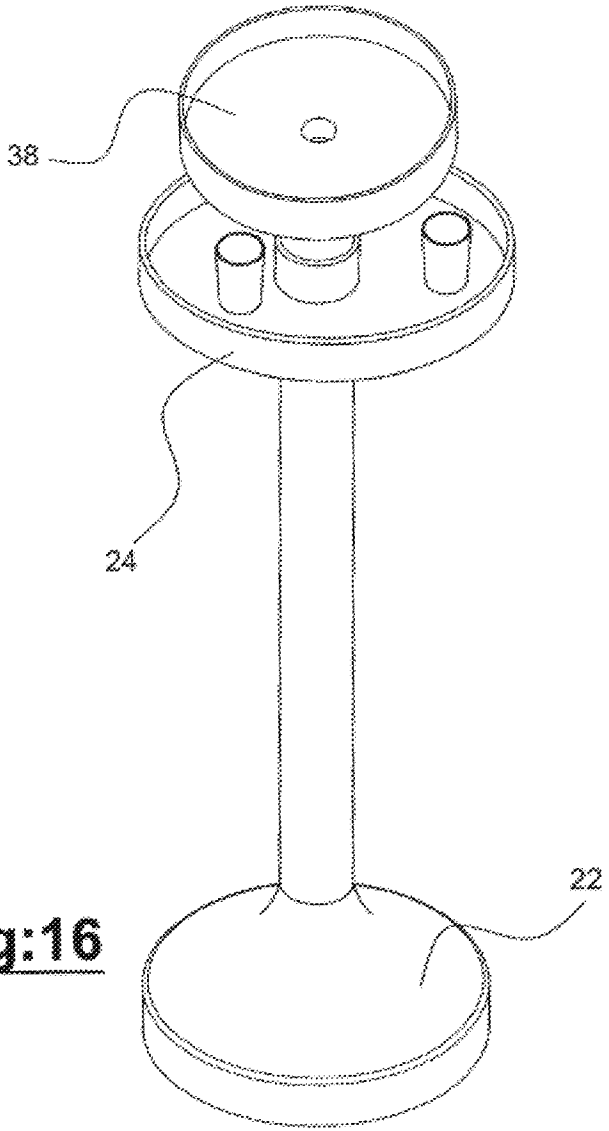
FIG. 16 shows the perspective view of the floor stand.

FIG. 16 shows a perspective view of the floor stand showing the disc-Ike socket (38) into which the cylinder (5) is mounted.

Figure 17:
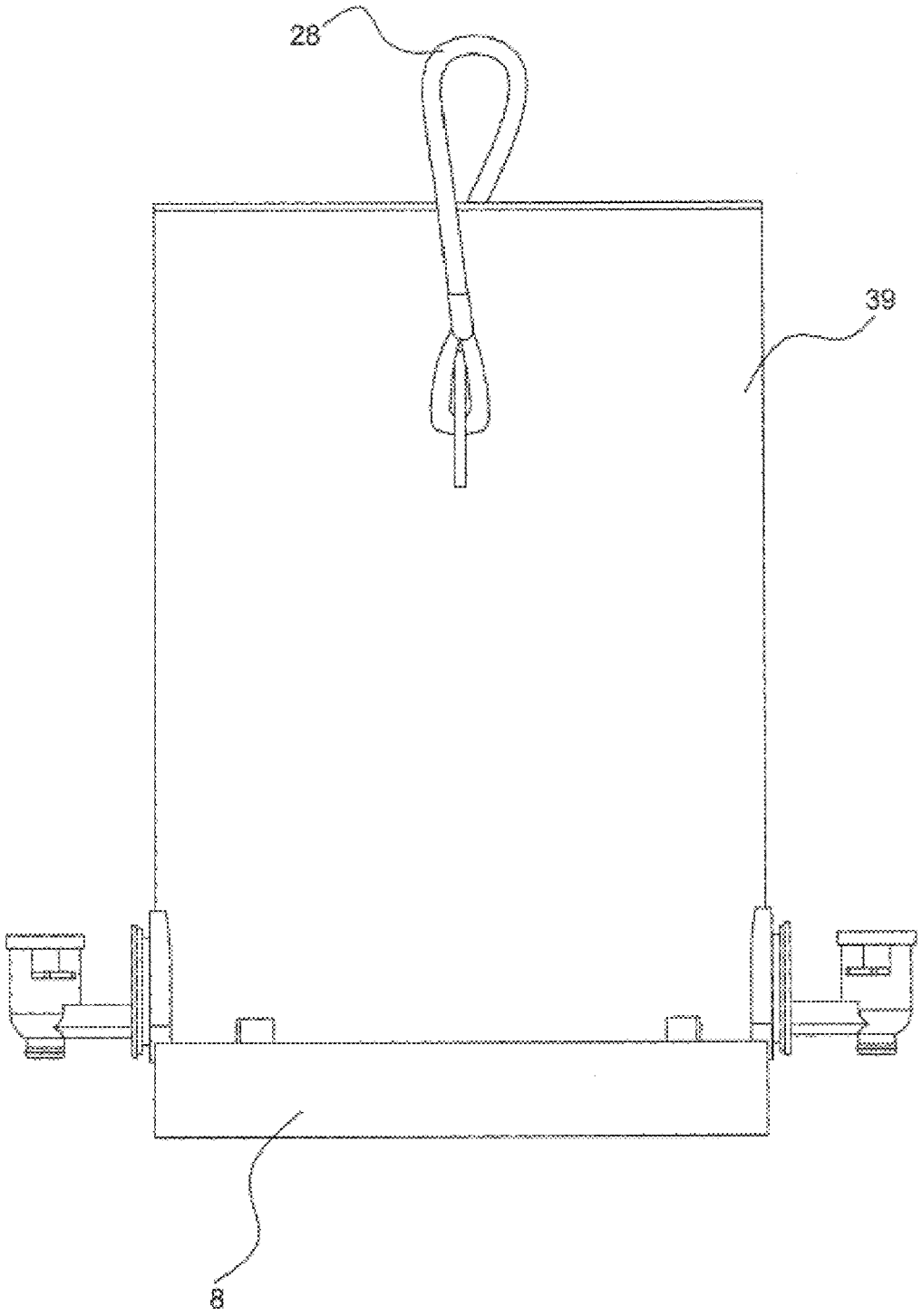
FIG. 17 shows the side view of a single part cylindrical container.

FIG. 17 shows a side view of an alternative cylindrical container (39) consisting of a single part cylinder (39). The cylinder (39) has a stable upper lid (40) and a lower lid (8) on the bottom.

Figure 18:
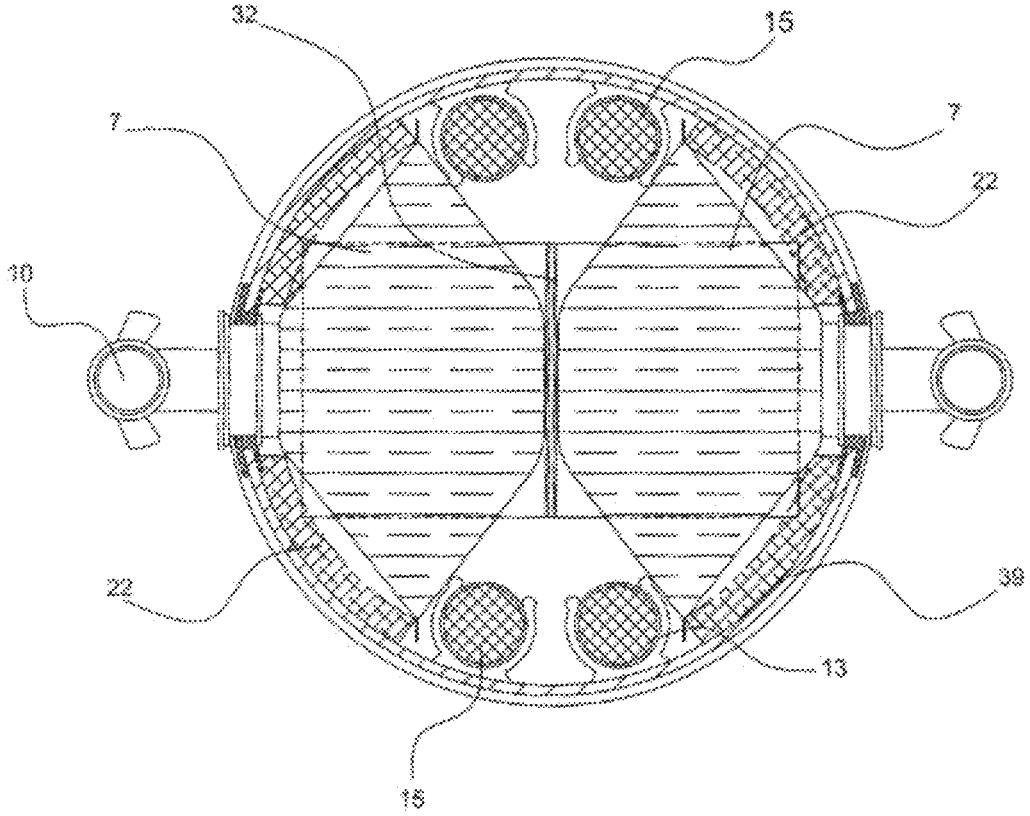
FIG. 18 shows the single part of cylindrical container at cross-section with two bags.

FIG. 18 shows a single part cylindrical container (39) in a cross-section showing the bags (7), the peripheral insulation (36), the ice packs (15), the taps (10) and the plastic plate (32) to aid the bags emptying.

Figure 19:
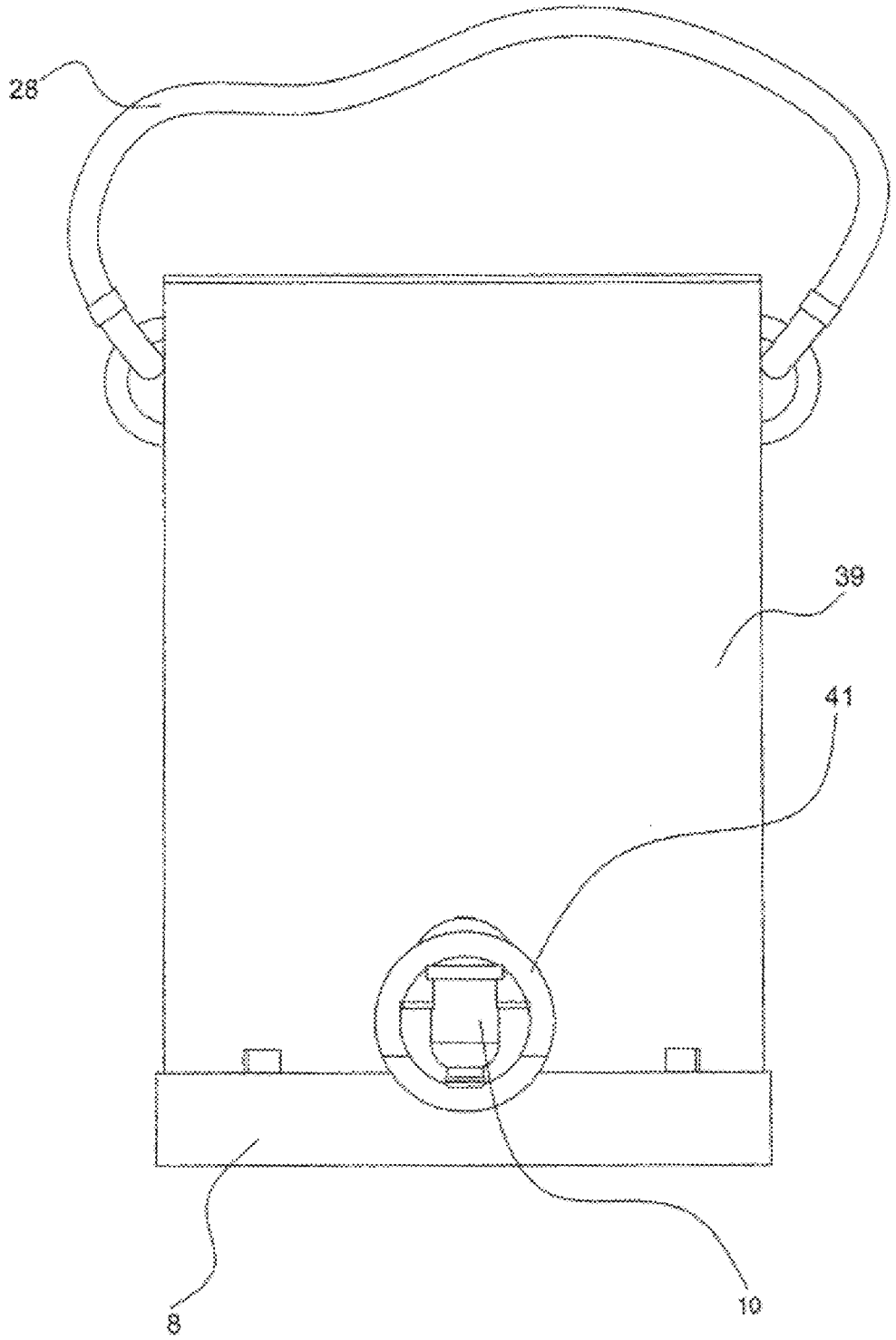
FIG. 19 shows the perspective view of a single part cylindrical container.

FIG. 19 shows in perspective a single part cylindrical container where the cock is shown (10).

Figure 20:
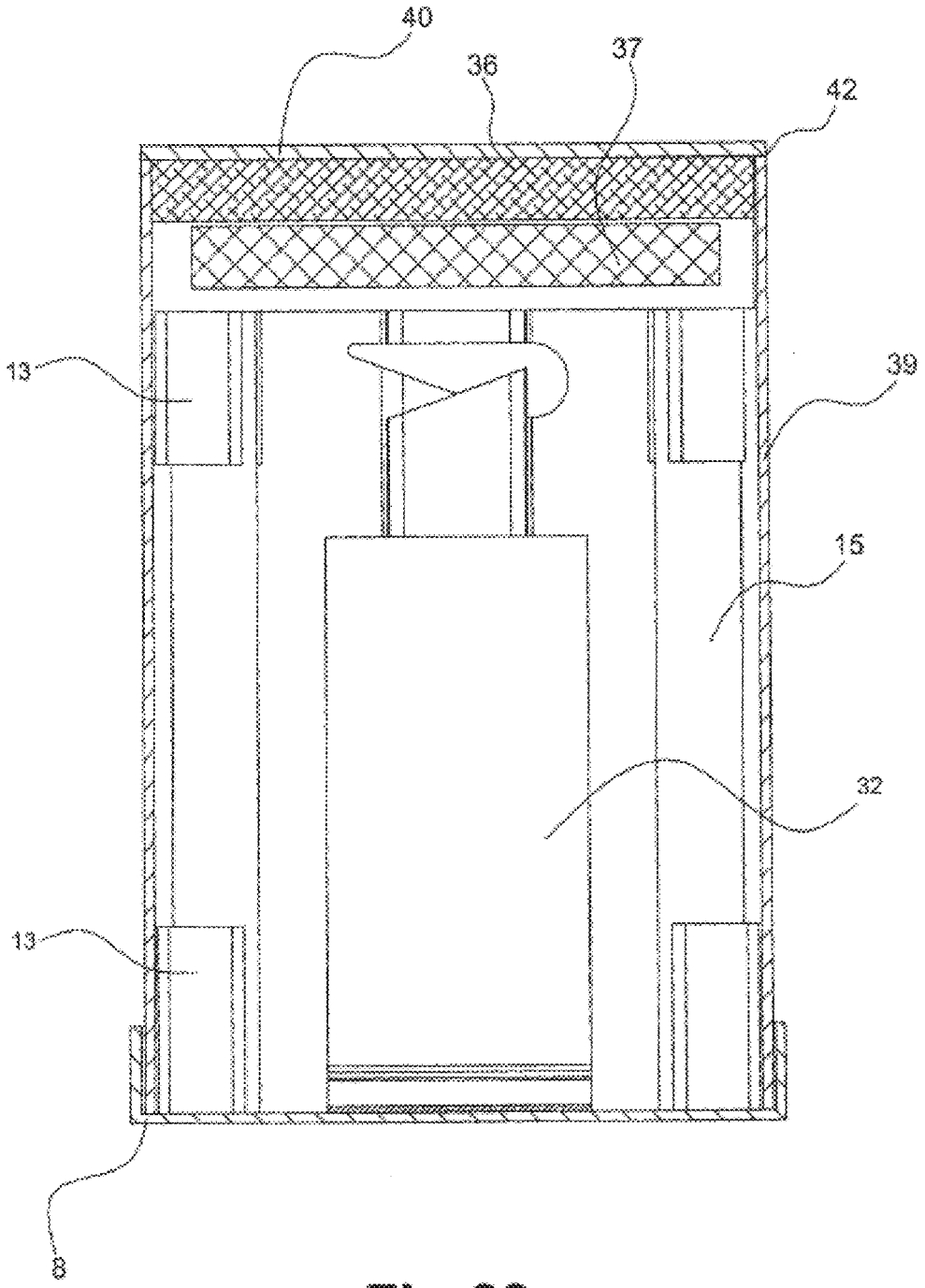
FIG. 20 shows the single part cylindrical container at cross-section height.

FIG. 20 shows a single part cylindrical container (39) in height showing inwardly the insulation (36), the upper ice pack (37), the side ice pack (15), the side ice pack retaining sockets (13) (15), lower lid (8), plastic plate (32) to aid bag emptying. The point (42) shows the point of fixing of the lid (40) with the cylinder (39).

Figure 21:
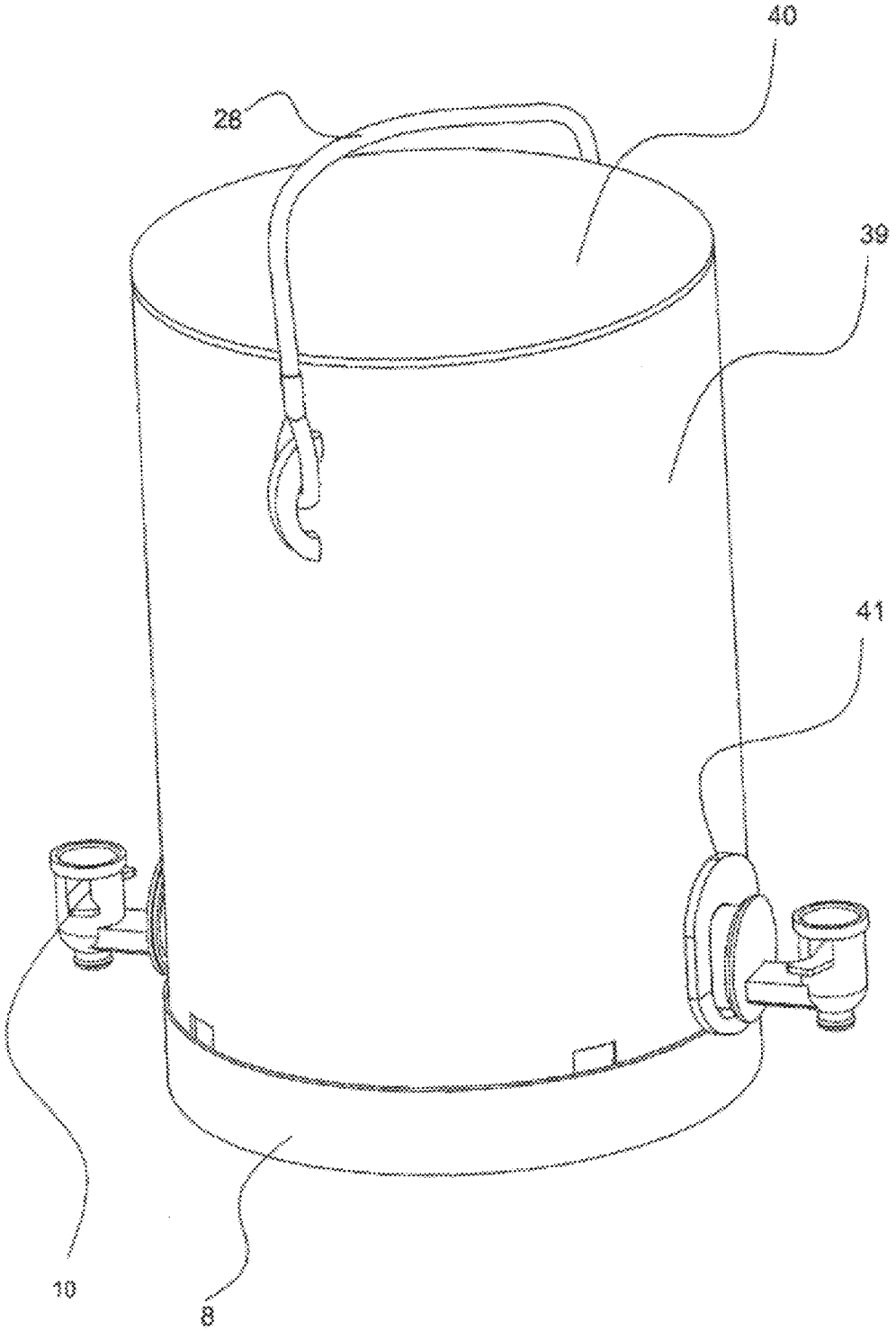
FIG. 21 shows the perspective view of the single part cylindrical container.
Figure 22:
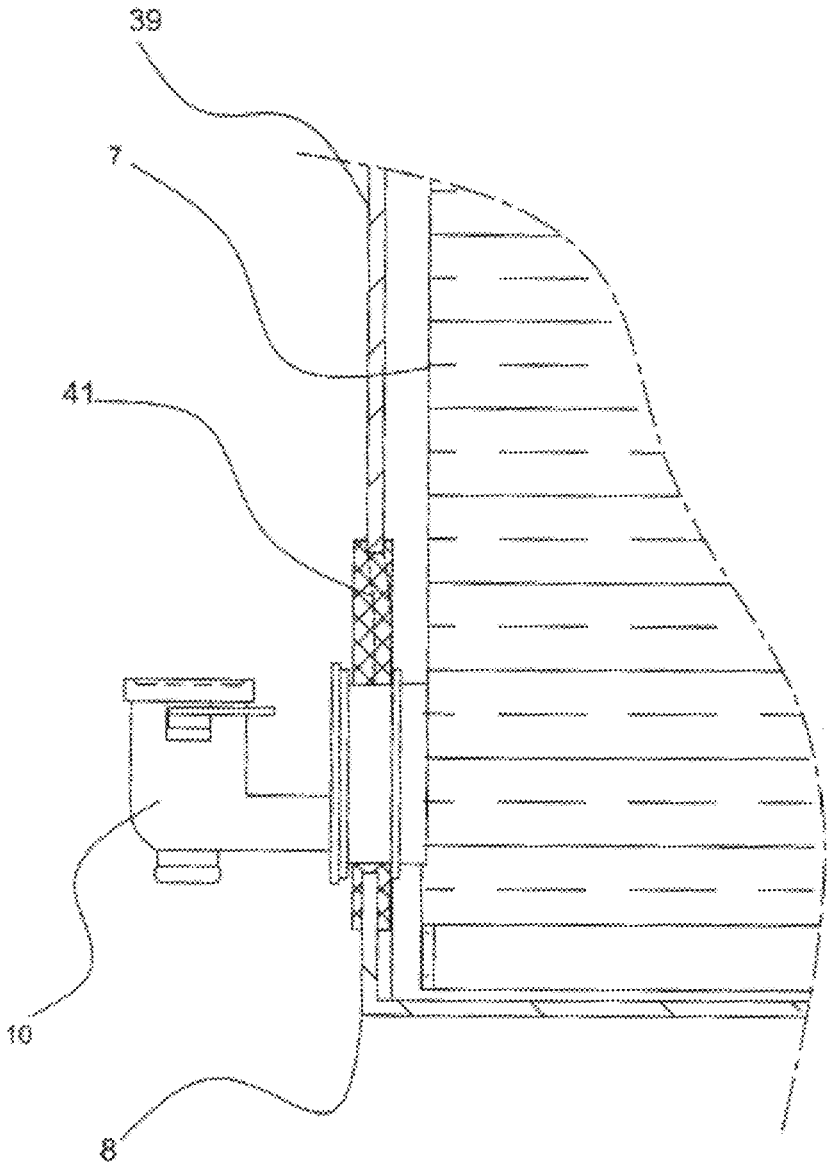
FIG. 22 shows the point of the cylindrical container's taps.

FIG. 21 is a perspective view of the single part cylindrical container (39) where the taps (10) are shown. FIG. 22 shows the point of passage of the taps through the cylindrical container (39) and the resilient gasket (41) embracing the tap (10) and the port (14) of the cylinder (39).

FIG. 23 shows a wire table base (43) in perspective showing the wire elements (43) it comprises. The upper formed portion (44) for mounting the cylindrical containers (5), (39) and the lower formed soles (46), FIG. 24 shows a wire table base in front.

FIG. 25 shows an alternative form of wire table base (47) perspectives. The bases (20) and (22) may be divided as described above but also in single part constructions. The structure propose according to the present invention may serve to accommodate one or two bags or provide for multiple bags to be provided with the corresponding cylinder configuration (5) and the corresponding size.

This invention is suitable for use in banquets, trips, but also for everyday family or business dinners. The construction materials can be plastic, glass, metals, wood, clay and any material that can be shaped and acquired the functional properties of the present construction. The size is not limited as well as the use of the liquids placed. These can be spirits, juices, oil, vinegar, milk etc.

The invention claimed is:

1. A drink dispensing device consisting of a cylinder having internally an insulation (36) in which stand up bags (7) are arranged, at lower parts of the stand up bags (7) stand up bags outlets (33) are arranged, wherein taps (10) are mounted in the stand up bags outlet (33), wherein the taps (10) are passed through ports (14) arranged at a lower part of the cylinder, wherein internally of the cylinder, holder ice packs (13) are provided, wherein ice packs (15) pass through the holder ice packs (13), wherein the lower part of the cylinder is closed with a lid (8), said lid (8) having protrusions (31), which are inserted in incisions (30) provided at the lower part of the cylinder, wherein an upper opening is closed with a lid (9, 40) which has internally an insulation (36), wherein in said lid (9, 40), protruding bars (34) having notches (35) are arranged, the notches (35) hold an ice pack (37), wherein the cylinder has two diametrically positioned configurations (29) through which a belt (28) for hanging the device is passed.

2. A drink dispensing device according to claim 1, wherein the device is positioned on a table base (20), the table base (20) being dividable and consisting of two parts, an upper part (3) and a lower part (4), wherein the two parts are connected by a screw (19).

3. A drink dispensing device according to claim 1, wherein the device is positioned on a base (22), the base (22) being dividable and consisting of an upper part (18) and a lower part (17), the upper part (18) and the lower part (17) being connected by a screw (19), wherein between the upper part (18) and the lower part (17), a tray (24) is arranged, wherein glasses (21) are positioned on the tray and any leakages from the taps are collected.

4. A drink dispensing device according to claim 1, wherein the device is positioned on a base (22), the base (22) being a single-part structure.

5. A drink dispensing device according to claim 1, wherein the device is positioned on a table base (20), the base (20) being a single-part structure.

6. A drink dispensing device according to claim 1, wherein between and below the stand up bags (7), plastic plates (32) are mounted, wherein the plastic plates press the bags (7) so that drinks are dispensed and emptying of the bags are complete.

7. A drink dispensing device according to claim 1, wherein the cylinder is a cylinder (39) which is a single, non-dividable part.

8. A drink dispensing device according to claim 1, wherein the cylinder is a two-part cylinder (5) being manufactured by two reclining parts (6) which are connected with hinges (11) and secured by latches (12).

* * * * *